US006102555A

United States Patent [19]

Mizoguchi

[11] Patent Number: 6,102,555

[45] Date of Patent: Aug. 15, 2000

[54] CONCAVE REFLECTING MIRROR FOR A LIGHT SOURCE

[76] Inventor: Toyoharu Mizoguchi, #504 Stoke Mansion, 5-12-35 Kitamachi, Warabi-shi Saitama-ken, Japan

[21] Appl. No.: 09/019,354

[22] Filed: Feb. 6, 1998

[30] Foreign Application Priority Data

Nov. 5, 1997 [JP] Japan ..... 9-010293

[51] Int. Cl.[7] ..... F21V 7/00

[52] U.S. Cl. ..... 362/347; 363/346; 363/297

[58] Field of Search ..... 362/346, 347, 362/348, 350, 297

[56] References Cited

U.S. PATENT DOCUMENTS

| | | | |
|---|---|---|---|
| 1,141,361 | 6/1915 | Schmidt et al. | 362/348 |
| 1,258,007 | 3/1918 | Hess | 362/348 |
| 1,287,298 | 12/1918 | Halvorson, Jr. et al. | 362/297 |
| 2,089,610 | 8/1937 | Kloos | 362/348 |
| 3,337,871 | 8/1967 | Greenberg et al. | 362/350 |
| 5,556,194 | 9/1996 | Natsume et al. | 362/346 X |

*Primary Examiner*—Laura K. Tso
*Attorney, Agent, or Firm*—Juettner Pyle & Piontek

[57] ABSTRACT

An improved reflective mirror for floodlights that can diffuse and reflect a beam of light from a light source in uniform brightness in a given floodlight area is provided. A concave reflecting mirror is provided with an aperture at the axis center of the mirror for inserting a light source such as a bulb, so that the inner periphery of the reflecting mirror is on the side and behind the light source. A plurality of reflectors are formed in the inner periphery of the reflecting mirror in a spiral profile when viewed from the front. The reflectors spiral out from the axis center of the reflecting mirror. Each of the reflectors has a convex or concave profile surface, so that a cross section of the reflective mirror inner periphery surface appears to be ribbed.

10 Claims, 4 Drawing Sheets

CONCAVE REFLECTING MIRROR FOR A LIGHT SOURCE

BACKGROUND OF THE INVENTION

The present invention comprises an improved reflecting mirror for spotlights. Conventional reflecting mirrors for spotlights are well known in the art. As shown in FIG. 1, these mirrors generally comprise a parabolic shaped dish with a reflective inner surface (1) and an aperture in the axial center through which a light source protrudes. The light source can be an incandescent lamp (3) which emits light when a filament (2) is energized with current. The reflective inner surface of the parabolic shaped dish reflects light from the light source forward, thereby efficiently illuminating the light source.

In this general configuration of a floodlight reflecting mirror, the reflected illuminated light can have uneven brightness. This results from an unevenness in the light emission from the filament source. In extreme cases, a magnified image of the filament may be projected.

To address this problem, reflective mirrors have been developed with a plurality of small, approximately round reflective spots on the inner periphery of the mirror, each individual spot with either a concave or convex surface. This configuration is designed to diffuse the reflected light so that more evenly diffused lighting is achieved. Although this configuration may improve the evenness of illuminated light, the process of creating and manufacturing such a reflective parabolic mirror is very difficult.

Another reflective mirror configuration designed to solve the problem of uneven reflected light is shown in FIG. 2. In this configuration, the reflective mirror inner periphery (4) is subdivided into a plurality of expanding annular rings (5) with their center at the reflective mirror axial center with a protruding incandescent lamp (6). Each of these annular rings has a convex surface, so that the reflected light will diffuse and be distributed more evenly. With this configuration uneven shading of the filament in the direction of the optic axis of the incandescent lamp (6) is diffused and brightness is made uniform by the reflection on the surface of the annular rings, the unevenness of the filament in the direction of the whole circumference that exists in the orthogonal plane to the optical axis cannot be diffused.

Therefore an unresolved need exists in industry for an effective and economically feasible floodlight reflective mirror.

OBJECT OF THE INVENTION

It is an object of the present invention to provide an improved spotlight reflective mirror that can equalize and evenly diffuse both the unevenness of a filament light source located in the direction of the light axis of the light source and the unevenness in shading of the filament located in the orthogonal direction to the direction of the light axis of the light source, and that can thereby reflect evenly illuminated light in a given floodlight area.

SUMMARY OF THE INVENTION

The present invention comprises an improved reflecting mirror for spotlights.

The present invention comprises a parabolic shaped reflective mirror with a reflective inner periphery surface. The mirror has an aperture near its center through which a light source, such as a light bulb, may protrude. When the light source is inserted through the reflective mirror's center aperture, the reflective inner surface of the mirror will reflect the light from the light source forward, thereby focusing the light towards a desired area.

The inner reflective surface of the present invention comprises a plurality of reflectors which when viewed from the front spiral outward from the reflective mirror center. Each of these spiraling reflectors has either a convex or concave surface, so that a cross sectional view of the reflective surface has ribs. The convex or concave surface of the spiraling reflectors allows for evenly diffused light along the axis of the reflective mirror bulb. Also, because the subsections are spiraled, the reflected light is also evenly diffused along the axis perpendicular to the reflective mirror bulb. Thus uneven light emanating from an unevenly illuminated filament in the direction of the whole circumference that exists in the orthogonal plane to the optical axis can be diffused.

DETAILED DESCRIPTION

Figure 1:
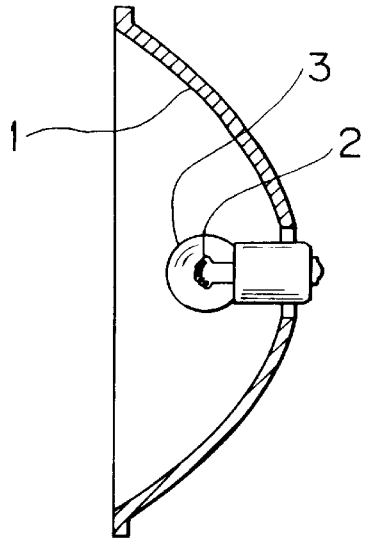
Fig. 1 PRIOR ART
FIG. 1 shows a typical spotlight reflective mirror of the prior art with light bulb.
Figure 2:
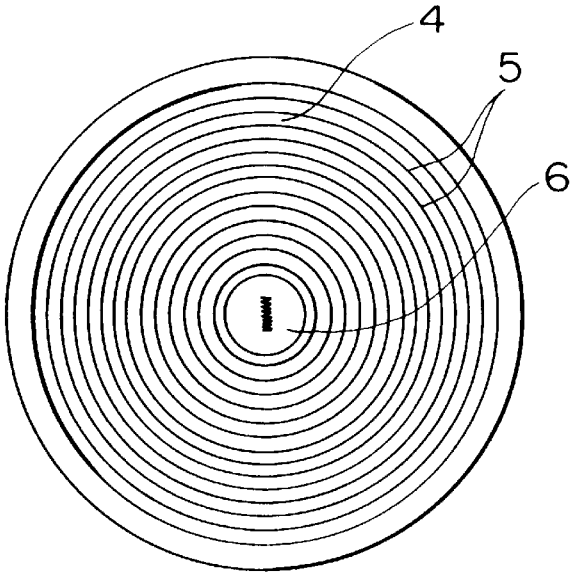
Fig. 2 PRIOR ART
FIG. 2 shows a prior art configuration.
Figure 3:
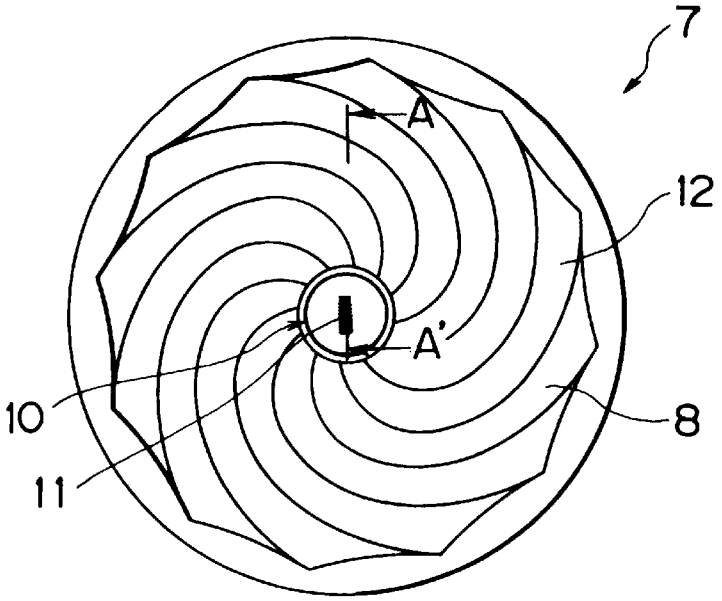
FIG. 3 shows a front view of an embodiment of the present invention.
Figure 4:
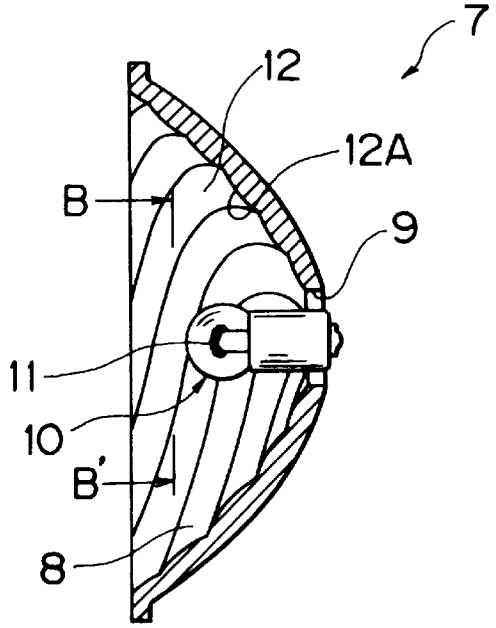
FIG. 4 shows a cross section of an embodiment of the present invention.

FIG. 3 shows a front view of a preferred embodiment of the present invention, while FIG. 4 shows a profile view of the same embodiment. A floodlight (7) has a parabolic shape, with reflective mirror with reflective inner surface (8). A bulb insertion hole (9) is formed at the axis center of the reflective mirror. An incandescent lamp (10) is inserted through the bulb insertion hole (9) as a light source such that the inner periphery (8) is at the side and back of the bulb. The incandescent bulb has a built in filament (11).

As shown in FIG. 3, a plurality of reflectors (12) configured in a spiraling effect when viewed from the front are formed on the inner periphery (8) of the mirror. These reflectors spiral out from and around the axis center of the reflective mirror. As shown in FIG. 4, each of these spiraling reflectors in this preferred embodiment of the invention has a convex surface (12A) so that a cross sectional view of the reflective surface reveals a ribbed structure. The reflective mirror in this preferred embodiment is constructed of injection molded plastic, with aluminum vapor deposited on the reflective surface.

As shown in FIG. 4, the basic shape of this preferred embodiment is a revolving paraboloid, with a focal distance of 13.1 mm, an effective outside diameter of 75 mm and an effective inside diameter of 22 mm. The reflective mirror is finely divided into 60 strips, each 1 mm wide, in a multiple spiral strip profile, with each strip reflecting surface (12A) in a convex circle profile with 1 mm width and a cross sectional curvature of 30 mm.

Figure 5:
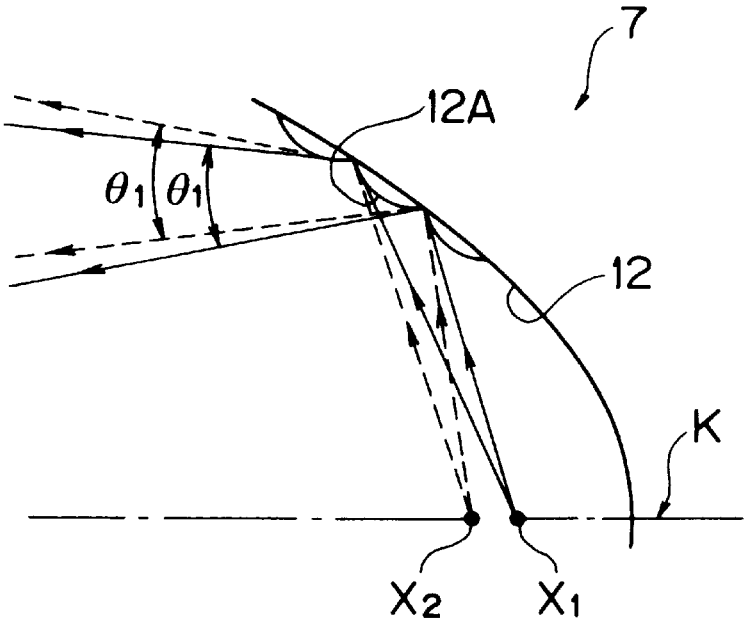
FIG. 5 diagrams light reflection patterns for an embodiment of the present invention.

As shown in FIG. 5, when the incandescent lamp (10) is turned on, a beam of light from the light emission point X1 of the filament (11) will travel along the path defined by the solid lines and run into the reflecting surface (12A) of the reflector (12), with the result that the reflected beam of light is diffused at a given average angle $\theta_1$ and irradiated to the front of the reflecting mirror for floodlight 7.

Also, if there exists another light emission point, such as X2 in FIG. 5 at the location on the light axis K, that is of a different strength than the light emission point X1, the beam of light from X2 will travel along the path shown defined by the broken lines in FIG. 5, and will be diffused by the reflector at a given average angle $\theta_1$, with the result that evenly diffused reflected lighting is achieved.

Figure 6:
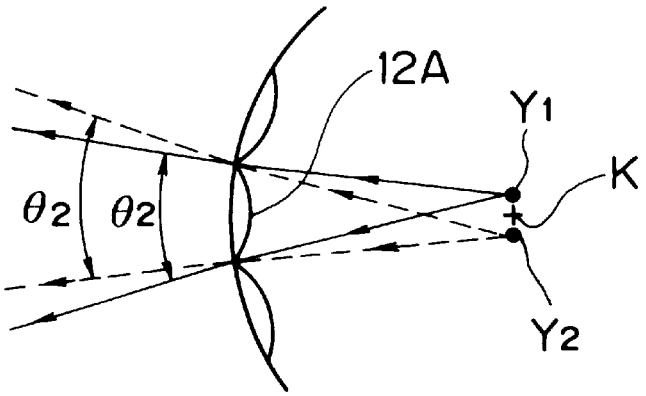
FIG. 6 diagrams light reflection patterns for an embodiment of the present invention.

FIG. 6 shows that the orthogonal cross section to the light axis K shows that the reflector (12) of the reflecting mirror for floodlight (7) is made as a circle type of reflecting surface (12A). Therefore, when a beam of light from the light emitting point Y1 travels along the path defined by the solid lines runs into this reflecting surface 12A, the beam is diffused in the direction of circumference within the range of an average angle $\theta_2$, and irradiated forward of the reflecting mirror for floodlight 7.

If there should exist another light emitting point Y2 on the same orthogonal plane to the axis of light K of the light emitting point Y1, the beam of emitted light from point Y2 will travel along the path defined by the broken line. This beam will be reflected at an average angle of $\theta_2$, thereby evening out the irradiated light from the ruminating points Y1 and Y2.

In this manner unevenness of the illuminated light can be prevented even using an unevenly lit filament bulb. The dimensions given above for this preferred embodiment of the invention will result in uniform floodlight being provided in an area 250 mm in diameter at a distance of 2 m from the front of the reflecting mirror.

Figure 7:
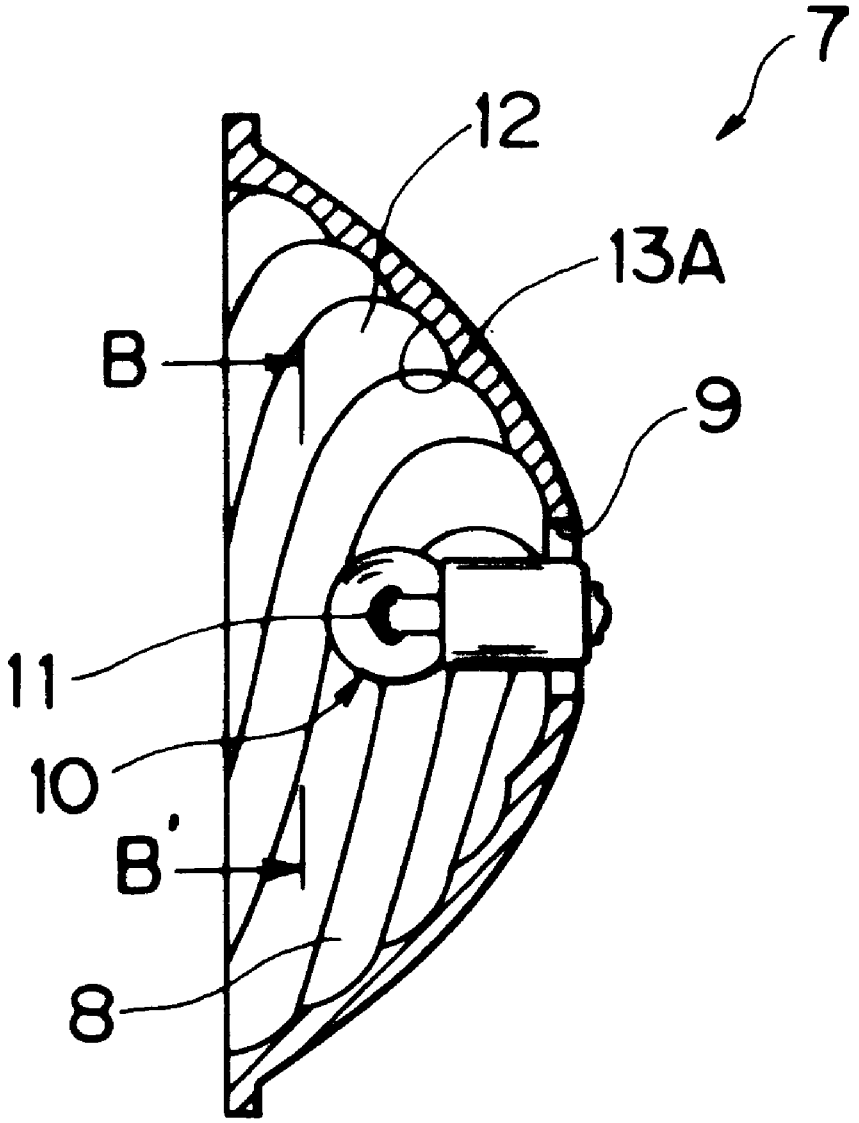
FIG. 7 shows a cross section of an embodiment of the present invention.

FIG. 7 shows an alternate embodiment of the invention. A plurality of reflectors (12) are formed in a spiral form when viewed from the front on the inner periphery (8) of the reflecting mirror for floodlight (7) starting at the axis center of the inner periphery (8). Each reflector (12) has a reflecting surface (13A) formed in a concave circle profile, with the result that a cross sectional view of the inner periphery surface is ribbed.

What is claimed is:

1. A reflector for a light source comprising:

a) a concave reflecting mirror, said reflecting mirror having an aperture near its center through which a light source protrudes, said reflecting mirror having a reflecting surface; and b) said reflecting surface being subdivided into a plurality of reflectors, said reflectors comprising ribs spiraling outward from and rotating around a center located at said reflecting mirror center aperture, said spiraling ribs each having a substantially arcuate surface.

2. The reflector for a light source as claimed in 1, wherein said spiraling rib substantially arcuate surface is convex.

3. The reflector for a light source as claimed in 1, wherein said spiraling rib substantially arcuate surface is concave.

4. A reflector for a light source as claimed in 1, wherein:

a) said concave reflecting mirror having an outside diameter substantially equal to 75 mm, said reflecting mirror aperture near its center having an inside diameter substantially equal to 22 mm, said reflective mirror having a focal distance substantially equal to 13.1 mm, b) said reflecting surface being subdivided into a multiplicity spiraling reflector ribs, each having a width substantially equal to 1 mm, c) said spiraling reflectors each having a convex surface having a width substantially equal to 1 mm and said spiraling reflectors having a curvature of the cross section substantially equal to 30 mm; and d) said reflective mirror being constructed of injection molded plastic with aluminum vapor deposited on said reflecting surface.

5. A reflecting mirror as in claim 1, wherein said reflecting surface reflects substantially all light incident thereupon so that substantially no light passes through said reflecting mirror.

6. A reflector for a light source as in claim 1, wherein said plurality of reflectors are adjacent one another, and wherein a path of reflection from said light source reflected off of one of said reflector substantially arcuate surfaces does not directly intersect an adjacent spiraling reflector.

7. A reflector for a light source as in claim 1, wherein light from said light source is reflected from said plurality of reflectors and is substantially evenly diffused forward of said reflector mirror.

8. A reflector for a light source as in claim 1, wherein said reflecting mirror having a circumference, wherein said light source comprises an unevenly lit filament, and wherein uneven light emanating from said unevenly lit filament is evenly diffused forward of said reflector mirror in a direction orthogonal to the plane of said reflecting mirror circumference.

9. A reflector for a light source as in claim 1, wherein said concave reflecting mirror is comprised of injection molded plastic, and said reflecting surface comprises vapor deposited aluminum.

10. A reflector for a light source comprising:

a) a concave reflecting mirror comprised of plastic, having a circumference, having an aperture near its center through which an unevenly lit filament light source protrudes, having an aluminum vapor deposited surface for reflecting light from said source, said vapor deposited surface reflecting substantially all light incident thereupon so that substantially no light penetrates through said reflecting mirror; and b) said reflecting surface being subdivided into a plurality of reflectors, said reflectors spiraling outward from and rotating around said reflecting mirror center aperture, said spiraling reflectors having a substantially arcuate individual surface, wherein light from said unevenly lit light source is reflected forward of said reflecting mirror and is substantially evenly diffused in a direction orthogonal to the plane of said mirror circumference.

* * * * *